US008559830B2

(12) United States Patent
Wayman et al.

(10) Patent No.: US 8,559,830 B2
(45) Date of Patent: Oct. 15, 2013

(54) LOCKOUT DEVICE AND AN INDICATOR TO ENSURE THAT THE CORRECT CONSUMABLE IS REPLACED IN A PRINTING DEVICE

(75) Inventors: William H. Wayman, Ontario, NY (US); Wayne D. Drinkwater, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 271 days.

(21) Appl. No.: 13/105,609

(22) Filed: May 11, 2011

(65) Prior Publication Data

US 2012/0288287 A1 Nov. 15, 2012

(51) Int. Cl.
*G03G 15/00* (2006.01)
*G03G 15/08* (2006.01)

(52) U.S. Cl.
USPC ..... 399/12; 399/27

(58) Field of Classification Search
USPC ..... 399/12, 24, 27; 101/318, 320, 321; 347/140
See application file for complete search history.

(56) References Cited

U.S. PATENT DOCUMENTS 3,754,214 A 8/1973 Matsumoto et al.
4,519,088 A 5/1985 Rademacher et al.
4,949,123 A * 8/1990 Takashima ..... 399/12
5,394,794 A * 3/1995 Arcotta ..... 101/43
6,032,010 A * 2/2000 Kim et al. ..... 399/12 X
6,249,654 B1 * 6/2001 Kurz et al. ..... 399/12
6,266,492 B1 * 7/2001 Maehara ..... 399/12
6,324,351 B1 * 11/2001 Kurimoto et al. ..... 399/12
6,661,977 B1 * 12/2003 Kubota ..... 399/12
6,766,119 B2 * 7/2004 Urabe ..... 399/12
6,826,373 B2 * 11/2004 Nomura ..... 399/12
6,934,688 B2 8/2005 Carter
7,597,253 B2 10/2009 Lin et al.
7,665,817 B2 2/2010 Folkins
7,677,448 B2 3/2010 Guan et al.
7,813,656 B2 * 10/2010 Dawson ..... 399/12
2009/0051745 A1 * 2/2009 Watanabe et al. ..... 347/86

* cited by examiner

*Primary Examiner* — Sandra Brase
(74) *Attorney, Agent, or Firm* — Ronald E. Prass, Jr.; Prass LLP

(57) ABSTRACT

According to aspects of the embodiments, there is provided methods of replenishing at least one consumable in a printer system having at least one channel with a lockout device and an indicator. The embodiments incorporate a solenoid latch on the channel, a channel closed switch and an attention light. When a consumable needs to be replaced, the user scans the new consumable label against a CRUM reader. If it is valid consumable for the printing system, the attention light above the low or empty channel is lit and its solenoid latch is released. The attention light and solenoid latch would be wired in parallel so that whenever the solenoid is energized to allow the channel to be opened, the attention light will illuminate.

20 Claims, 7 Drawing Sheets

LOCKOUT DEVICE AND AN INDICATOR TO ENSURE THAT THE CORRECT CONSUMABLE IS REPLACED IN A PRINTING DEVICE

BACKGROUND

Disclosed herein are methods to prevent the wrong consumable from being used in a printing device, and in particular to such methods for ensuring that the correct color toner cartridge is replaced in a printing device, as well as corresponding apparatus.

It is often desirable to control access to an ink barrel within a printing device in order to safeguard against accidental or unintended addition of ink. This is particularly the case where the wrong ink may be harmful to printing systems. The wrong color ink added to a barrel will contaminate the entire ink system inclusive of the barrel, melter, ink lines and the heads. If this mistake is made, there will be a service disaster. The printing system could be down for days and it could get very expensive in replacement parts.

The increase in the number of abilities and features of printers has resulted in tremendously complex electronic and mechanical designs. With more complex designs come more potential problems and more possibilities for operator error. For instance, with the advent of color copying and printing, it is possible for the operator to use the wrong color ink to refill one of the barrels, and unless some type of safe guard mechanism to prevent it is provided, this can have disastrous consequences. The operator can follow certain operational procedures to insure that the correct ink is inserted or introduced to the correct barrel. Unfortunately, even with all of the checks that are provided, it is still possible for the operator to make a serious mistake when refilling the printer with ink. Nothing prevents the operator from trying to fill a full or partially full barrel or toner hopper. The use of color ink like in color laser printer only helps to add another dimension to existing problems. For instance, an operator might not pay attention to the particular color, might simply grab the wrong color, or may even assume that because a particular color is empty, so too must be the black, cyan and yellow in their respective barrels.

For the reasons stated above, and for other reasons stated below which will become apparent to those skilled in the art upon reading and understanding the present specification, there is a need in the art for informing an operator that a consumable needs to be replenished and, in particularly, there is a need in the art for a lockout mechanism for controlling access to an ink barrel in a printing system.

SUMMARY

According to aspects of the embodiments, there is provided methods of replenishing at least one consumable in a printer system having at least one channel with a lockout device and an indicator. The embodiments incorporate a solenoid latch on the channel, a channel closed switch and an attention light. When a consumable needs to be replaced, the user scans the new consumable label against a CRUM reader. If it is valid consumable for the printing system, the attention light above the low or empty channel is lit and its solenoid latch is released. The attention light and solenoid latch would be wired in parallel so that whenever the solenoid is energized to allow the channel to be opened, the attention light will illuminate.

DETAILED DESCRIPTION

Figure 1:
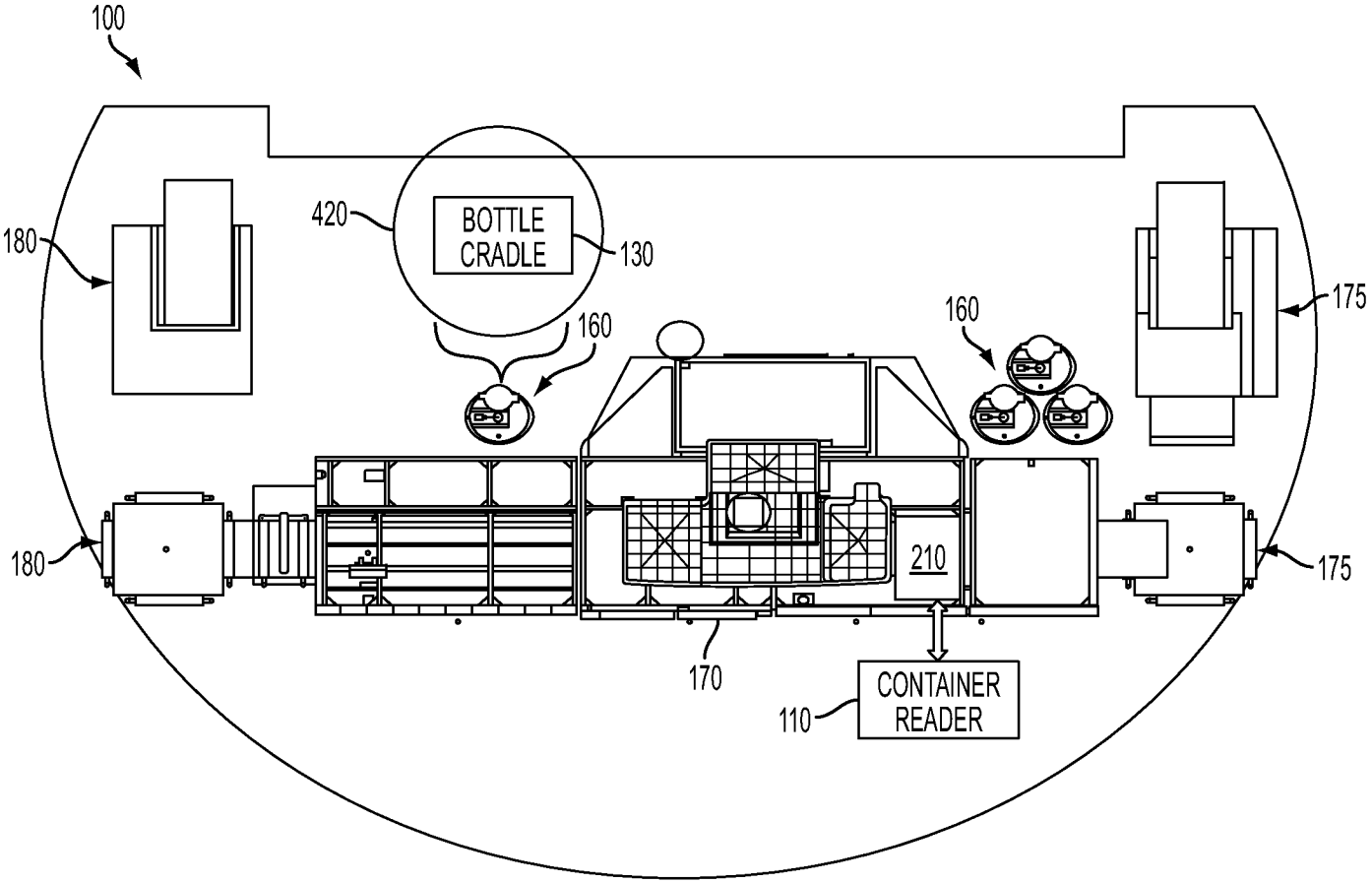
FIG. 1 is a simplified elevational view of a printing system with machine controller capable for ensuring that the correct consumable is replaced in a printing device in accordance to an embodiment.

Aspects of the embodiments disclosed herein relate to methods for replenishing at least one consumable in a printer system having at least one channel with a lockout device and an indicator, and corresponding apparatus and system. The disclosed embodiments comprise controller, latch mechanism, and attention light for notifying the operator which of the channel has been approved for receiving a consumable.

The disclosed embodiments include a printing system comprising at least one marking engine, each of the marking engines selectively receiving at least one consumable which is consumed during rendering of images by the marking engine; a cover with lockout device and indicator positioned on at least one marking engine, wherein the lockout device prevents the introduction of the consumable when in an inactive state and permits introduction of the consumable when in an active state; a reader to read an electronically-readable memory device that identifies the type of consumable in a container; and a controller coupled to the reader, to the lockout device, and to the indicator for controlling which of the least one marking engine can receive the consumable in the container; wherein the indicator when in an active state signals which of the marking engines is permitted to receive the consumable.

The disclosed embodiments further include a printing system wherein the lockout device has a lockout element that is positioned to prevent opening the cover at the at least one marking engine from being opened during an inactive state, and is movable to permit the consumable to enter when in the active state.

The disclosed embodiments further include a printing system wherein the lockout element comprises circuitry for supplying electrical current to move the lockout element to the permitting position when the lockout device is in the active state.

The disclosed embodiments further include a printing system wherein the lockout element has a distal end that is engageable with a barrel at the at least one marking engine to prevent substantial displacement of the container with the consumable into the barrel when the lockout element is in the inactive state.

The disclosed embodiments further include a printing system wherein upon placement of the lockout device into the activated state, the distal end of the lockout element is retracted to permit displacement of the consumable into the barrel.

The disclosed embodiments further include a printing system wherein the controller further performs disabling any future reading of the electronically-readable memory device on the container when the consumable in the container can replenish the printing system.

The disclosed embodiments further include a printing system wherein the controller having an associated memory for storing a replenishing condition, and wherein the controller is configured to send a signal to place the lockout device in the activated state only after the container has been identified to contain a consumable that can satisfy the replenishing condition.

The disclosed embodiments further include a method to replenish at least one consumable in a printer system having at least one channel with a lockout device and an indicator comprising a container with a consumable for the printer system, wherein the container has an electronically-readable memory device that identifies the type of consumable in the container; reading the electronically-readable memory device on the container to determine if the consumable in the container can replenish the printer system; and supplying electrical current to the lockout device and indicator to place a lockout device and an indicator in an active state when the consumable in the container can replenish the printer system, thereby permitting the transfer of the consumable through a channel with a lockout device and indicator in the active state; wherein the indicator when in an active state signals which of the at least one channel is permitted to receive the consumable in the container.

The disclosed embodiments further include an apparatus to control insertion of color inks into a printing system comprising at least one compartment to receive at least one of the color inks for the printing system, wherein each compartment has a bottle cradle operable to open and close and thereby restrict access to the compartment; an input device operable to receive input from a container with color ink for the printing system; and a controller coupled to the input device and to each bottle cradle and operable to control access to at least one compartment by receiving the input and comparing the input to stored information to generate one of a plurality of results to unlock and identify one of the compartments that can receive the color ink in the container.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

The computer-readable media store instructions that may be executed by a processor to perform various functions. For example, the computer-readable media may store instructions for ensuring that the correct consumable is replaced in a printing system by performing the methods illustrated in FIG. 6 and FIG. 7.

The term "printing device" or "printing system" as used herein refers to a digital copier or printer, scanner, image printing machine, digital production press, document processing system, image reproduction machine, bookmaking machine, facsimile machine, multi-function machine, or the like and can include several marking engines, feed mechanism, scanning assembly as well as other print media processing units, such as paper feeders, finishers, and the like. "printing system" can handle sheets, webs, marking materials, and the like. A printing system can place marks on any surface, and the like and is any machine that reads marks on input sheets; or any combination of such machines.

The term "print media" generally refers to a usually flexible, sometimes curled, physical sheet of paper, plastic, or other suitable physical print media substrate for images, whether precut or web fed.

The term "container" includes any container in which something is packed for storage or transportation. It is contemplated that the container may include one or more: envelope, a wrapper, a pallet, a carton, a can, a jar, a tray, a trunk, a sleeve, a cargo container, and the like.

The term "bottle cradle" generally refers to a station at a compartment that houses a developer for a printing system. The bottle cradle control access to the compartment so as to prevent the material in the compartment from contamination or unauthorized depletion.

The term "marking engine" generally refers to a device for applying an image to print media. The exemplary printing system may include marking engines and a variety of other components, such as finishers, paper feeders, and the like, and may be embodied as a copier, printer, or a multifunction machine.

The term "consumable" refers to anything that is used or consumed by an imaging device during operations, such as print media, developer material, marking material, cleaning fluid, and the like.

The term "compartment" as used herein means a section or zone into which the developer of a particular color in a printing system has been divided or merely identified or labeled as such. Such compartments can be in fluid communication with another compartment of a printing system. For example, a compartment can be a container or barrel that can be partially or entirely physically separated from a second compartment, but comprises pipes or other means for fluid communication with a second compartment.

FIG. 1 is a simplified elevational view of a printing system 100 with machine controller capable for ensuring that the correct consumable is replaced in a printing device in accordance to an embodiment.

The illustrated printing system 100 is a direct-to-sheet, continuous-web, phase-change ink printer suitable for implementing aspects of the exemplary method. It is to be understood that other types of printers are contemplated. A very long (i.e., substantially continuous) web W of "substrate" (paper, plastic, or other printable material), supplied on a spool, is unwound as needed, propelled by a variety of motors (not shown). The web W moves through a printing station including a series of marking stations or print heads, each print head effectively extending across the width of the web and being able to place ink of one primary color directly (i.e., without use of an intermediate or offset member) onto the moving web, and an image processor (not shown) that sends image data to each print head. As is generally familiar, each of the four primary-color images placed on overlapping areas on the web W combine to form a full-color image, based on the image data sent to each print head. There may be multiple print heads for each primary color; the print heads can each be formed into a single linear array; the function of each color print head can be divided among multiple distinct print heads located at different locations along the process direction; or the print heads or portions thereof can be mounted movably in a direction transverse to the process direction P, such as for spot-color applications. In larger printing environment there could be for example sixteen (16) banks each containing four print heads per bank. In such a printing system there would be a total of 84 print heads.

Figure 2:
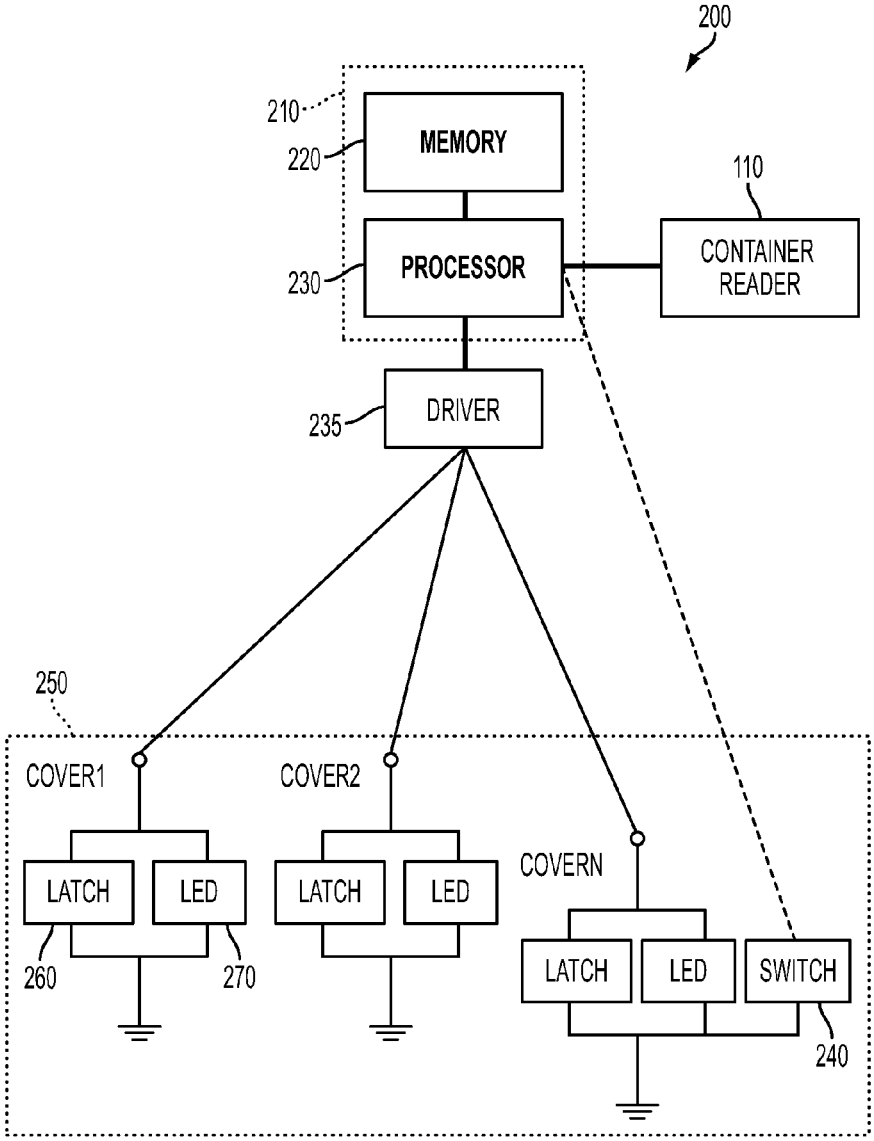
FIG. 2 illustrates a block diagram of an electronic lockout device that may be used to ensure that the correct consumable is replaced in a printing device in accordance to an embodiment.
Figure 5:
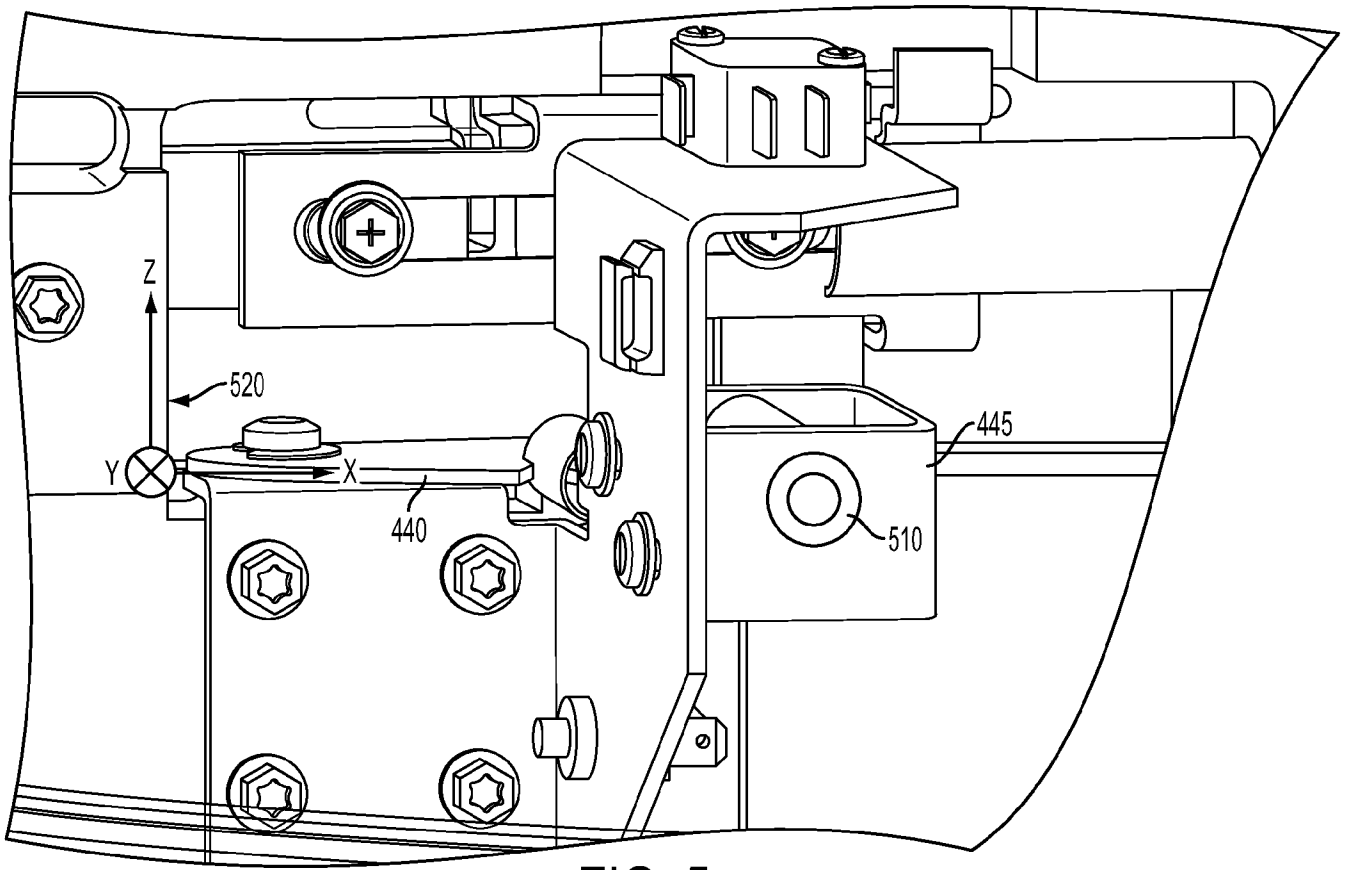
FIG. 5 is an illustration of a lockout element with solenoid to move the lockout element in accordance to an embodiment.

The illustrated printing system 100 incorporates a media roll input 175, media roll input adapter, multiple printing modules 170, a media roll output adapter and a media roll output 180. The printing system uses individual ink barrels 160, one for each color, located in at or near the printing modules 170. The ink barrels each have a lid 420 or bottle cradle 130 comprising an indicator light, slide valve, and solenoid latch on the slide valve as shown in FIG. 2 and FIG. 5. Optionally the bottle cradle 130 could include a CRUM reader in communication with a controller. A container reader 110 contains a coupler that can read and/or write electronic data from the tag on container so that it could be processed by a control system 210. The multiple print modules 170 includes processing components distributed over the printing system 100 and includes a marking engine controller (not shown) such as a CPU, associated with each marking engine (not shown), which includes actuators for controlling each of the subsystems, and an overall control system 210, which communicates with the individual marking engine CPUs. The marking engine controller is linked to the system controller 210 and may be also linked to other known components, such as a memory, a marking cartridge platform, a marking driver, bottle cradle, a function switch, a self-diagnostic unit, all of which can be interconnected by a data/control bus. Details of controller function in a printing environment can be found, for example, in U.S. Pat. No. 7,665,817 to Falkins, the disclosure of which is hereby incorporated by reference in its entirety.

It should be noted that printing system 100, shown in FIG. 1, is merely an example of a system to which the present technology may be advantageously applied. The present technology is not limited to this system and in fact, contemplates application to and implementation in any type of system in which multiple replaceable unit exist. Additional non-limiting examples of systems to which the present technology may be applied include xerographic or other photocopiers, paper handlers, document finishers, scanners, printers, fax machines, and the like. In addition, one of skill in the art would recognize that the present technology is not limited to implementation with programmable devices. Although, for simplicity, this document uses the term programmable device, it is to be understood that the present technology may be implemented relative to any type of software or firmware based processor, such as microcontrollers, microprocessors, computer systems, and the like, and that the term programmable device encompasses any such software or firmware based processor.

FIG. 2 illustrates a block diagram of an electronic lockout device 200 that may be used to ensure that the correct consumable is replaced in a printing device in accordance to an embodiment. The electronic lockout device consists of a controller 210, a container reader 110, a driver 235 circuitry for supplying electrical current to a latch solenoid 260 with light emitting device (LED) 270 combination, and a switch 240 such as an open/close switch at each cover. The function of the controller could be performed by machine controller as described in FIG. 1. As shown in FIG. 2, a separate controller could be employed provided that a processor 230 and a memory 220 are included to perform in combination the data processing. Processor 230 compares the input from container reader 110 to stored information, e.g. consumable type and quantity, to generate one of a plurality of results, e.g. open the slide valve or request another container, to unlock and identify one of the compartments that can receive the color ink in container 106.

Processor 230 may include at least one conventional processor or microprocessor that interprets and executes instructions. The processor 230 may be a general purpose processor or a special purpose integrated circuit, such as an ASIC, and may include more than one processor section. Additionally, the controller 210 may include a plurality of processors 230.

Memory 220 may be a random access memory (RAM) or another type of dynamic storage device that stores information and instructions for execution by processor 230. Memory 220 may also include a read-only memory (ROM) which may include a conventional ROM device or another type of static storage device that stores static information and instructions for processor 230. The memory 220 may be any memory device that stores data for use by controller 210.

The controller 210 may perform functions in response to processor 230 by executing sequences of instructions or instruction sets contained in a computer-readable medium, such as, for example, memory 220. Such instructions may be read into memory 220 from another computer-readable medium, such as a storage device, or from a separate device via a communication interface, or may be downloaded from an external source such as the Internet (not shown). The system may be a stand-alone system, such as a personal computer, or may be connected to a network such as an intranet, the Internet, and the like. Other elements may be included with the system 210 as needed.

The container reader 110 contains a coupler that can read and/or write electronic data from the tag on container 106. The container reader 110 is any device that generates a modulated, electromagnetic carrier signal to be received by a tag, and receives data from the tag by detecting loading effects on the carrier signal. Similarly, a tag is any device that receives a modulated, electromagnetic carrier signal transmitted by a reader and superimposes data onto the carrier signal by load variation.

The processor receives an identification of the content in a container through container reader 110, the processor using instructions and information from memory 220 then decides whether a latch solenoid for a compartment (Cover1 . . . CoverN) should be energized thus allowing the content of the container to be received and used by a printing system. The compartments for each barrel is protected by a bottle cradle 250 that comprises an indicator light, slide valve, and solenoid latch on the slide valve for controlling access to the compartment. In the simplest case the instruction can be "IF" the content is ink "M" and a low or empty signal for ink "M" has been received "THEN" energized and illuminate, through driver 235, the appropriate cover such as CoverN. Other function could be performed such as crediting pixels to the print head that receives the ink, disable the reading of the tag in the container, disable the reading of other tags until a reset signals like re-closing of the cover, and other functions that are well known to CRUM users in the printing arts. An open/closed switch 240 would signal processor 230 that the particular dump valve has been opened and closed by the operator. As noted above the consumables can be housed in compartments arranged in bottle cradle 250 of the printing system.

Figure 3:
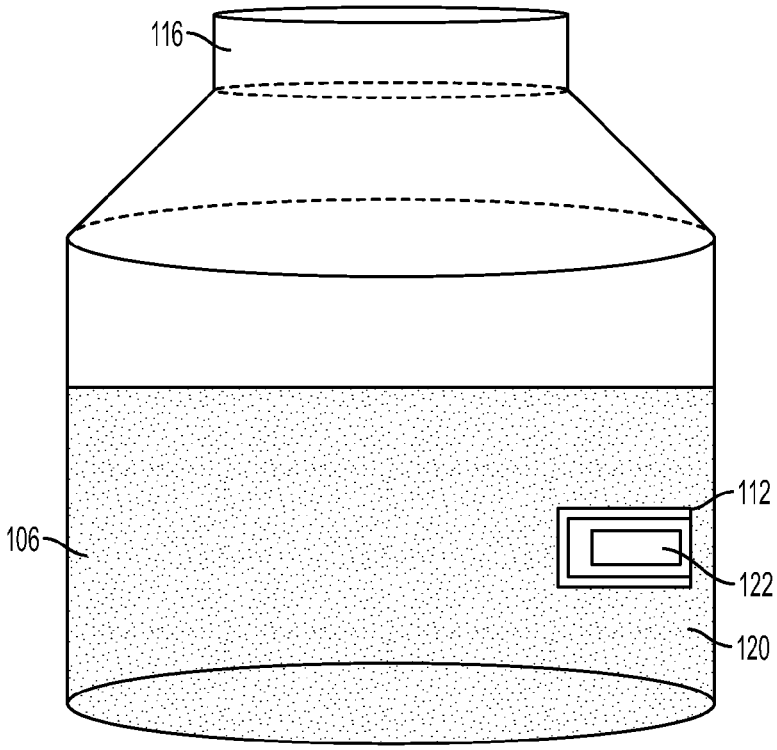
FIG. 3 is a perspective view of a container or bottle provided with a CRUM tag in accordance to an embodiment.

FIG. 3 is a perspective view of a container or bottle provided with a CRU tag in accordance to an embodiment. FIG. 3 shows a cylindrical container or bottles 106 suitable for packaging a liquid product, such as ink, for example, wherein the container is provided with a tag 112. In one case, the tag 112 is affixed to the side wall 120 of the container 106, but it could also be affixed to a removable cap 116. The cap 116 itself is of a conventional design having generally cylindrical side walls and a generally flat top surface. The tag 112 including its associated tag antenna 122 is affixed, imbedded or imprinted on the surface 120 of the of the container 106. The ink container 106 is generally stored in a separate bottle within a printing machine or storage area along with its tag 112 that is generally affixed on the side wall 120 of the container 106. The tag contains data relative to the ink product and can be ascertained using a reader. The tag 112 is an electronically-readable memory device, which is configured as a CRUM (Customer Replaceable Unit Monitor). The memory core in each CRUM (tag) 112 retains data relevant to the identification, function, color, and performance of the respective ink in the container 106. Because it includes a non-volatile memory, the CRUM 112 can act as a "scratch pad" for retaining the data stored therein, which travels with the ink, even when the ink are not installed in the printing system 100. If the controller 210 determines that the consumable in container 106 can replenish the printing system, the controller 210 communicates with the CRUM 112 affixed to the container 106, via a coupler in container reader 110, to disable the CRUM 112, thereby preventing reuse of the CRUM 112 in another container.

Figure 4:
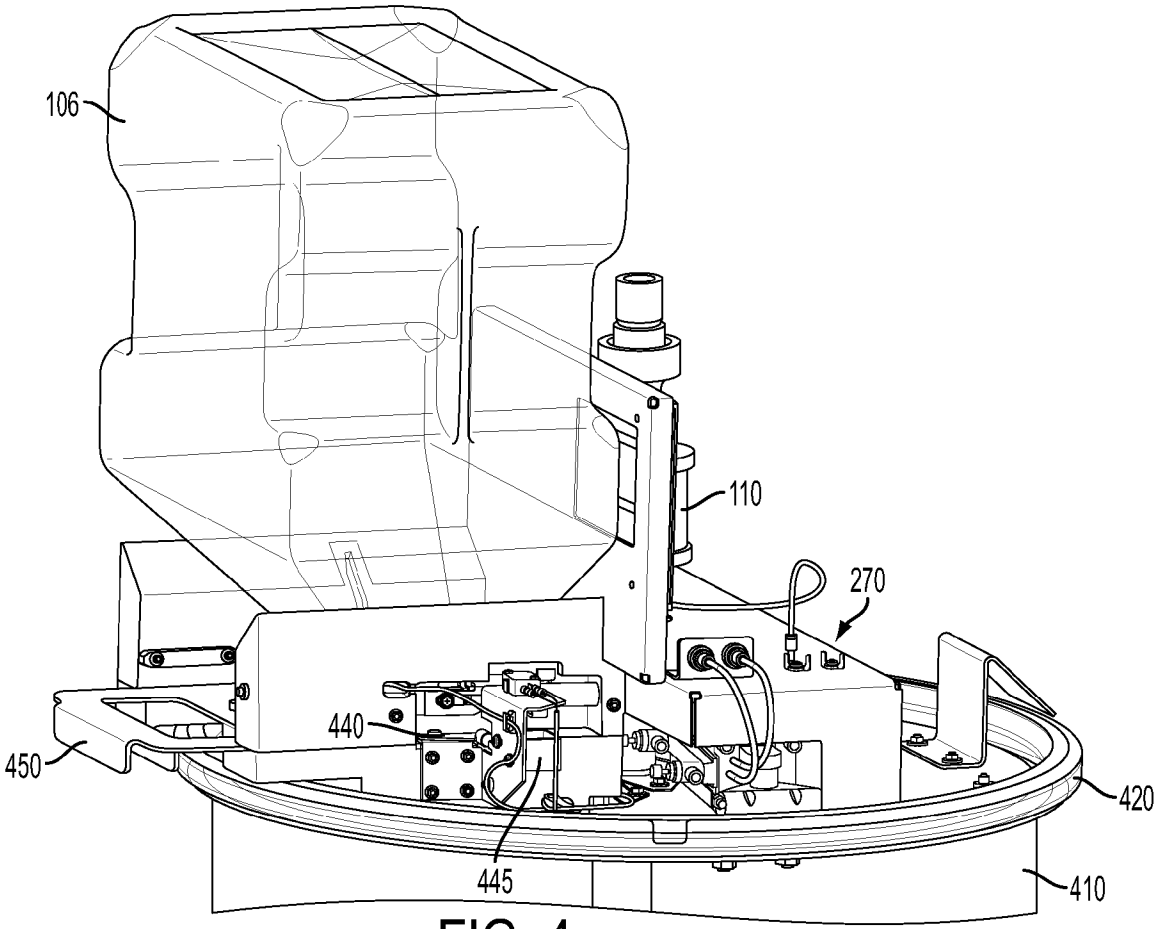
FIG. 4 is a view of the container, tag reader, cover, and lockout device for ensuring that the correct consumable is replaced in a printing system in accordance to an embodiment.

FIG. 4 is a view of the ink barrel, tag reader, cover, and lockout device for ensuring that the correct consumable is replaced in a printing system in accordance to an embodiment. The compartments for each ink barrel 410 is protected by a bottle cradle that comprises an indicator light or LED 270, slide valve or slide cover 450, and solenoid latch on the slide valve for controlling access to the compartment. The illustrated embodiment includes a dedicated CRUM reader or container reader 110. The container 106 with a tag is irradiated by the coupler in container reader 110 to ascertain the type of consumable therein. A light emitting device 270 such as an LED and a lockout/locking device such as a solenoid latch 260 are energized when the content in container 106 meets a predetermined criterion. The solenoid latch 260 consist of a solenoid coil 445 and distal element 440 that attaches to part of the barrel 410 or lid 420 to prevent entry into the barrel. If the consumable in the container 106 is the type that belongs in barrel 410 then a slide cover 450 on lid 420 is allowed to move and the content in container 106 is able to freely move or drop into barrel 410.

FIG. 5 is an illustration of a lockout element with solenoid to move the lockout element in accordance to an embodiment. The lockout element comprises solenoid coil 445 and distal element 440. A coil is provided to cause distal element 440 to retract when current is passed through solenoid coil 445. An axis of movement 520 is shown for distal element 440. The distal element 440, as shown, moves in the "Y" coordinate of the axis of movement 520. A spring 510 is held within solenoid coil to maintain distal element 440 in an extended position (outward movement) when not energized. In the extended position, distal element 440 engages a surface such as the cover or barrel to prevent the content of container 106 from being introduced into the barrel. In this way, no current is required by solenoid coil 445 to maintain distal element in the extended position. As such, receiving of outside particles from the canister or the ambient environment is prevented in the absence of any supplied power, i.e., when lockout device is in the inactive state. When electric current is supplied to solenoid coil 445, the distal element 440 retracts (inward movement) to permit the cap 116 of container 106 to be inserted passed the cover of barrel 410 and to allow the consumable to enter or a metered amount to be dispensed where it may be used by the printing system. When the solenoid coil receives electrical energy the lockout device is in the active state and movement of the slide cover is possible. A switch 240 as described in FIG. 2 which engages part of the cover. When the operator moves the slide cover 450 a short distance or open/closes the cover it is sensed by the controller. In some embodiments, the signal from an opening switch may be used to prevent operation of the reader and the opening of other covers. In some embodiments, the signal from a closing switch may be used to credit pixel counts and other functions and to disable any future reads of the tag on the container.

Figure 6:
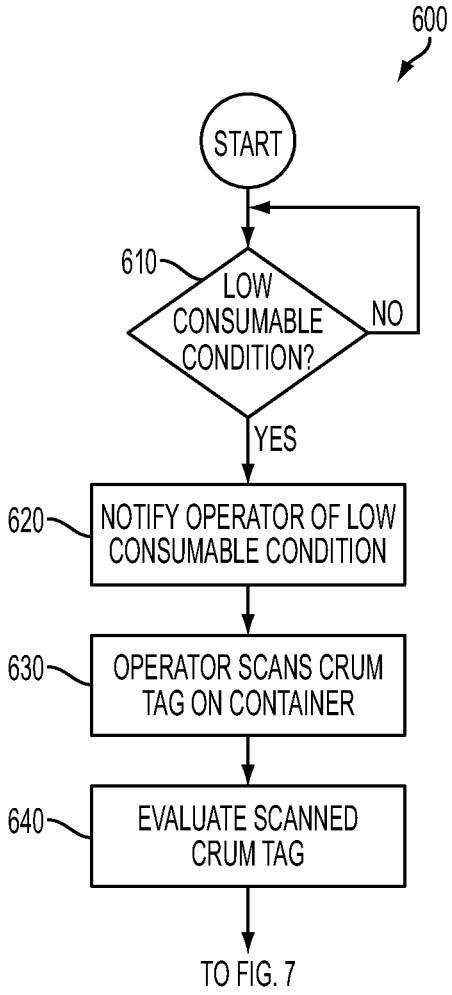
FIG. 6 illustrates a flowchart of a method for ensuring that the correct consumable is replaced in a printing system in accordance to an embodiment.

FIG. 6 illustrates a flowchart of method 600 for ensuring that the correct consumable is replaced in a printing system in accordance to an embodiment. Method 600 begins with a computing device like controller 210 or machine controller 36 listing for low consumable condition 610 for a printing system like printing system 100 (press) in FIG. 1. The listening continues until a low consumable condition such as an empty barrel or within a certain amount indicative of a lack of resources to perform a particular print job. In the case where the consumable is a developer like ink, the processing system, controller 210, can ascertain using pixel credits from a memory in printing system 100 an indication as to the quantity of consumable needed to replenish a particular ink barrel. When a low consumable condition is found control is then pass to action 620. In action 620, the operator is notified of the low consumable condition. The notification includes the color and the location of the consumable that registered the low consumable conditioned. It should be understood that when only one barrel per color is used then a color will suffice as notification for both type and location. However, when multiple barrels of the same color are used then the operator is notified as to the position of the low consumable condition.

In action 630, the tag on the container selected by the operator to replenish the low consumable condition is scanned using a reader like container reader 110. As noted earlier the electronically-readable memory device (tag) on the container has information like the color and other identifiers. Control is then passed to action 640 for evaluation of the information in the tag relative to the low consumable condition. For example, the tag may indicate that the operator just scanned a yellow solid ink bottle with "X" liters of ink. The low consumable condition may have indicated that yellow solid ink bottle with "X" liters of ink was needed to replenish the printing system. Control is then passed to action 650 for further processing.

Figure 7:
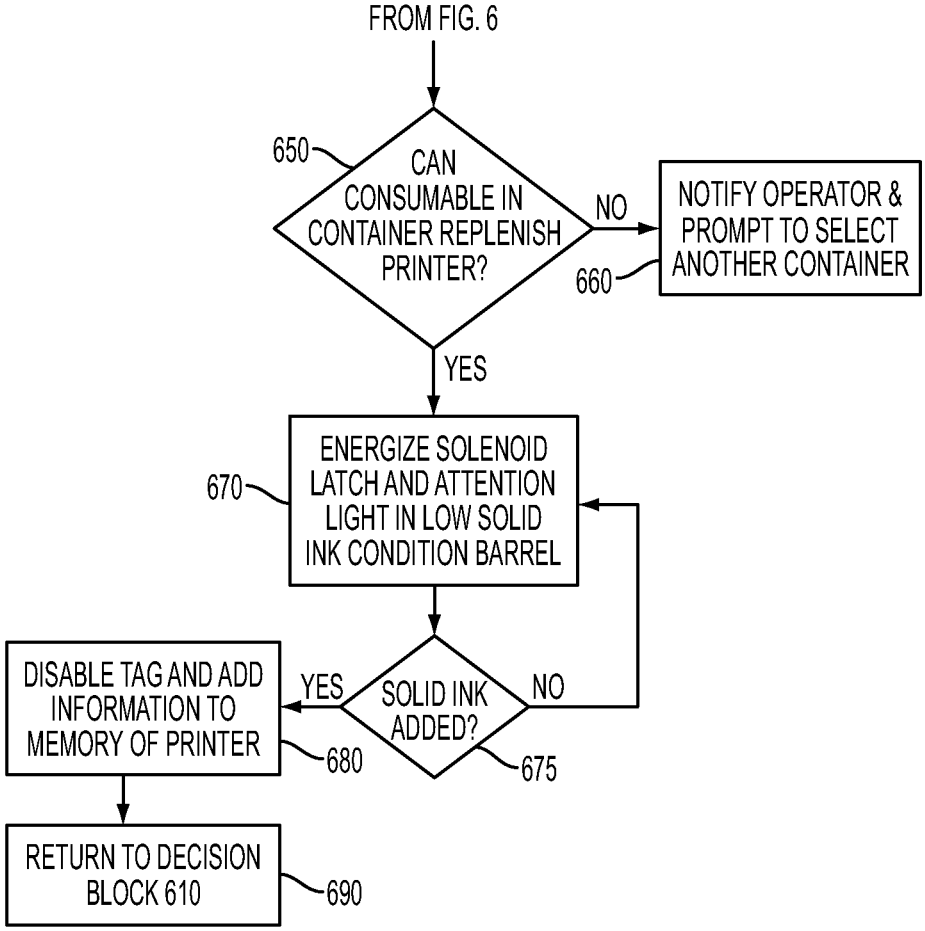
FIG. 7 illustrates a flowchart of a procedure for the electronic lockout device in FIG. 2 when the consumable can replenish a printing system in accordance to an embodiment.

FIG. 7 illustrates a flowchart of a procedure for the electronic lockout device in FIG. 2 when the consumable can replenish a printing system in accordance to an embodiment. In action 650 the computing device determines if the consumable in the container just scanned by the operator can replenish the printing system. If the computing device determines that the selected container has the ink needed for the printer based on the low solid ink condition then control is passed to action 670 for further processing. However, if the answer is "NO" because the color in the container does not match the low solid ink condition then action 660 causes the computing device to generate a message notifying the operator to select another container that can replenish the printing system.

In action 670, the computing device energizes the solenoid latch and the attention light at the barrel of the low solid ink condition. The computing system then waits until the solid ink has been added to the printing system. In action 675 the controller listens for an open event and a close event as indicated by the open/close switch 240 described in FIG. 2. Control is then passed to action 680 and 690 for further processing. In action 680, the tag on the container is disabled and information is added to the memory of the printing system. In action 690 control is returned to action 610 where the computing device listens for another low solid ink condition.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printing system comprising:

at least one marking engine each associated with at least one ink barrel to selectively receiving at least one consumable which is consumed during rendering of images by the marking engine;

a cover with lockout device and indicator positioned on the at least one ink barrel, wherein the lockout device prevents the introduction of the consumable when in an inactive state and permits introduction of the consumable when in an active state;

a reader to read an electronically-readable memory device that identifies the type of consumable in a container; and a controller coupled to the reader, to the lockout device, and to the indicator for controlling which of the least one marking engine can receive the consumable in the container;

wherein the indicator when in an active state signals which of the ink barrels is permitted to receive the consumable.

2. The printing system according to claim 1, wherein the lockout device has a lockout element that is positioned to prevent the cover at the at least one ink barrel from being opened during an inactive state, and is movable to permit the consumable to enter a when in the active state.

3. The printing system according to claim 2, wherein the lockout element comprises circuitry for supplying electrical current to move the lockout element to the permitting position when the lockout device is in the active state.

4. The printing system according to claim 3, wherein the lockout element has a distal end that is engageable with a latch at the at least one ink barrel to prevent substantial displacement of the consumable into an ink barrel when the lockout element is in the inactive state.

5. The printing system according to claim 4, wherein upon placement of the lockout device into the activated state, the distal end of the lockout element is retracted to permit displacement of the consumable into the ink barrel.

6. The printing system according to claim 1, the controller further performing disabling any future reading of the electronically-readable memory device on the container when the consumable in the container can replenish the printing system.

7. The printing system according to claim 6, wherein the controller having an associated memory for storing a replenishing condition, and wherein the controller is configured to send a signal to place the lockout device in the activated state only after the container has been identified to contain a consumable that can satisfy the replenishing condition.

8. A method to replenish at least one consumable in a printer system having at least one channel with a lockout device and an indicator, the method comprising:

providing a container with a consumable for the printer system, wherein the container has an electronically-readable memory device that identifies the type of consumable in the container; reading the electronically-readable memory device on the container to determine if the consumable in the container can replenish the printer system; and supplying electrical current to the lockout device and indicator to place a lockout device and an indicator in an active state when the consumable in the container can replenish the printer system, thereby permitting the transfer of the consumable through a channel with a lockout device and indicator in the active state;

wherein the indicator when in an active state signals which of the at least one channel is permitted to receive the consumable in the container.

9. The method according to claim 8, wherein the lockout device has a lockout element that is positioned to prevent the consumable from entering a channel during an inactive state, and is movable to permit the consumable to enter a channel when in the active state.

10. The method according to claim 9, further comprising:

disabling any future reading of the electronically-readable memory device on the container when the consumable in the container can replenish the printer system.

11. The method according to claim 10, wherein the lockout element has a distal end that is engageable with a cover latch at the least one channel to prevent flowing of the consumable in the container into a barrel when the lockout element is in the inactive state.

12. The method according to claim 11, wherein upon placement of the lockout device into the activated state, the distal end of the lockout element is retracted to permit the flow of consumable in the container into the barrel.

13. The method according to claim 9, further comprising:

preventing the reading of other electronically-readable memory devices until the lockout element in the lockout device is reset to an inactive state.

14. An apparatus to control insertion of color inks into a printing system, the apparatus comprising:

at least one compartment to receive at least one of the color inks for the printing system, wherein each compartment has a bottle cradle operable to open and close and thereby restrict access to the compartment;

an input device operable to receive input from a container with color ink for the printing system; and a controller coupled to the input device and to each bottle cradle and operable to control access to at least one compartment by receiving the input and comparing the input to stored information to generate one of a plurality of results to unlock and identify one of the compartments that can receive the color ink in the container.

15. The apparatus in accordance to claim 14, wherein the input from container is from an electronically-readable memory device that identifies the type of color ink in the container.

16. The apparatus in accordance to claim 15, wherein each bottle cradle has a slide valve with solenoid latch and indicator light that when in an active state signals which of the compartments is permitted to receive the color ink in the container.

17. The apparatus in accordance to claim 16, wherein the solenoid latch when in an active state allows opening of the slide valve to receive the color ink in the container.

18. The apparatus in accordance to claim 17, wherein the slide valve has a distal end that is engageable with the compartment to prevent opening of the slide valve when the lockout element is in an inactive state.

19. The apparatus in accordance to claim 18, wherein the controller having an associated memory for storing a replenishing condition, and wherein the controller is configured to send a signal to place the slide valve in the activated state only after the container has been identified to contain a color ink that can satisfy the replenishing condition.

20. The apparatus in accordance to claim 19, the controller further performing disabling any future reading of the electronically-readable memory device on the container when the color ink in the container can replenish the printing system.

* * * * *